US005871809A

United States Patent [19]

Liedtke et al.

[11] Patent Number: 5,871,809

[45] Date of Patent: Feb. 16, 1999

[54] PROCESS FOR THE PREPARATION OF A MULTICOAT REFINISH

[75] Inventors: Hermann Liedtke, Hohenlockstedt; Herbert Kortwinkel, Münster, both of Germany

[73] Assignee: BASF Lacke + Farben, AG, Muenster-Hiltrup, Germany

[21] Appl. No.: 649,647

[22] PCT Filed: Nov. 12, 1994

[86] PCT No.: PCT/EP94/03755

§ 371 Date: May 20, 1996

§ 102(e) Date: May 20, 1996

[87] PCT Pub. No.: WO95/14540

PCT Pub. Date: Jun. 1, 1995

[30] Foreign Application Priority Data

Nov. 20, 1993 [DE] Germany ..... 43 39 612.7

[51] Int. Cl.[6] ..... B05D 1/36; B05D 1/02; B05D 3/02

[52] U.S. Cl. ..... 427/140; 427/142; 427/379; 427/421; 427/407.1

[58] Field of Search ..... 427/140, 142, 427/421, 409.1, 282, 379

[56] References Cited

U.S. PATENT DOCUMENTS

| | | | |
|---|---|---|---|
| 3,930,069 | 12/1975 | Stephens | 427/142 |
| 4,201,799 | 5/1980 | Stephens | 427/142 |
| 4,265,936 | 5/1981 | Prohaska, Jr. | 427/142 |
| 4,313,970 | 2/1982 | Jones et al. | 427/208.4 |
| 4,420,520 | 12/1983 | Jones et al. | 427/421 |
| 4,814,200 | 3/1989 | Propst | 427/142 |
| 5,102,692 | 4/1992 | Tanigami et al. | 427/142 |
| 5,128,176 | 7/1992 | Schmidt | 427/140 |
| 5,254,192 | 10/1993 | Speakman | 427/140 |
| 5,283,084 | 2/1994 | Lau | 427/412.1 |
| 5,334,420 | 8/1994 | Hartung et al. | 427/409 |
| 5,336,716 | 8/1994 | Kappes et al. | 427/421 |
| 5,633,037 | 5/1997 | Mayer | 427/140 |

FOREIGN PATENT DOCUMENTS

| | | |
|---|---|---|
| A0 333 934 | 9/1989 | European Pat. Off. . |
| A36 09 961 | 1/1988 | Germany . |

*Primary Examiner*—Diana Dudash

[57] ABSTRACT

The present invention relates to a process for the preparation of a multicoat refinish, in which process a metallic basecoat is applied by spraying to the pretreated old finish and dried and then a clearcoat is applied to the basecoat and the clearcoat is dried together with the basecoat. The process is characterized in that the aqueous basecoat composition is applied such that a) in a first spray pass the aqueous basecoat composition is applied to the pretreated area of the old finish until a boundary is reached, b) the area of the old finish coated in step (a) is then coated in a second spray pass with the aqueous basecoat composition, c) steps (a) and (b) of the process are repeated in the region of the old finish which adjoins the previously coated region of the old finish, again until a boundary is reached, and d) process step (c) is carried out until the entire component to be coated is provided with a basecoat.

9 Claims, No Drawings

PROCESS FOR THE PREPARATION OF A MULTICOAT REFINISH

FIELD OF THE INVENTION

The present invention relates to a process for the preparation of a multicoat refinish, in which 1. the old finish is prepared by cleaning, sanding and, if desired, applying a surfacer and/or filler material,
2. an aqueous basecoat composition is applied, by means of spray application, which contains metallic pigments and/or effect pigments,
3. a polymer film is formed from the composition applied in step (2),
4. a suitable transparent topcoat composition is applied to the resulting basecoat, and
5. subsequently the topcoat together with the basecoat is dried at temperatures of up to 140° C., preferably at temperatures below 100° C. and particularly preferably at temperatures of from 60° to 80° C.

BACKGROUND OF THE INVENTION

The substrates suitable for refinish are either an old finish (production-line finish or repair finish), new parts which have been primed (mostly by electrodeposition, especially in the area of the finishing of heavy goods vehicle bodies), and also steel, aluminum, zinc plate or plastic. The choice of suitable coating materials and the process employed for the preparation of a refinish are determined by the surface to be finished and by the requirements of the customer.

A multicoat refinish is conventionally prepared by thorough cleaning of the damage site, sanding, treatment, if desired, with a surfacer and application of a repair filler to the area to be coated. In the case of all-over finishes, the entire old finish to be coated is pretreated analogously. Subsequently the area pretreated in this way is finished.

In this context, however, the preparation of metallic refinishes is a particular problem, because the color and brightness of the effect depend heavily on the manner of processing. Decisive factors at play here include the nozzle width of the spray gun and the spray pressure. The nature of dilution and the spray viscosity also influence color and effect. Especially when using aqueous basecoat compositions, clouding and similar effects are often observed.

The object of the present invention was therefore to provide a process for the preparation of a refinish having a very good quality, even in the case of critical colors. This means that changes in color, clouding and the like are to be avoided.

SUMMARY OF THE INVENTION

This object is surprisingly achieved by a process of the type mentioned in the FIELD OF THE INVENTION section, which is characterized in that in step (2) of the process the aqueous basecoat composition is applied such that a) in a first spray pass the aqueous basecoat composition is applied to the pretreated area of the old finish until a boundary is reached, b) the area of the old finish coated in step (a) is then coated in a second spray pass with the aqueous basecoat composition, c) steps (a) and (b) of the process are repeated in the region of the old finish which adjoins the previously coated region of the old finish, again until a boundary is reached, and d) process step (c) is carried out until the entire component to be coated is provided with a basecoat.

Surprisingly, using the process according to the invention it is possible to obtain refinishes in which the problems that usually occur are avoided or at least sharply reduced. In particular, the clouding which is frequently observed in the conventional refinish processes is avoided. In this context, it is significant that these outstanding results can also be achieved while using aqueous metallic basecoats. A further advantage is the saving in time brought about by the fact that there is only a brief flash-off time and, particularly preferably, no flash-off time at all between the first and second spray pass.

DESCRIPTION OF THE PREFERRED EMBODIMENTS

This process according to the invention for the preparation of a multicoat refinish can be applied to a wide variety of substrates. In this context, it is irrelevant whether the systems to be provided with the refinish are conventional or are water-dilutable.

In order to carry out the process according to the invention, the old finish is first prepared to receive the refinish. Conventionally, for this purpose, the old finish is first thoroughly cleaned, for example with a silicone stripper, and roughened with abrasive paste or sandpaper. Thereafter, the area pretreated in this way is conventionally cleaned again and degreased. In addition to this, however, it is also possible to precoat the old finish, for example, using a solution of adhesion promoter. This preparation of the old finish, however, is known and therefore requires no further description.

If desired, the appropriately pretreated old finish can then have applied to it an aqueous or water-dilutable or else a conventional coating composition. For this operation, it is conventional to apply highly diluted clearcoats that may be aqueous, water dilutable, and conventional. If conventional clearcoats are applied, then drying must be carried out before the basecoat is applied. This is conventionally effected by heating the clearcoat film to a temperature of below 140° C., preferably below 80° C., for a period of 5–60 min. If aqueous coating compositions are employed for this step of the process, then it is possible, if desired to do without a baking step: after a brief flash-off time of 5–50 min. the basecoat composition can be applied directly. If the old finish is presprayed with such a clearcoat, then it is possible if desired, to do without the sanding of the old finish. Conventionally, however, the above-described pretreatment of the old finish is carried out by cleaning and sanding. Aqueous clearcoats that are suitable for this pretreatment of the old finish are described, for example, in DE-A-40 09 000. In addition, however, it is also possible to employ the conventional clearcoats that are normally employed for this purpose, as marketed, for example, by the company Glasurit GmbH.

It is essential to the invention that a basecoat composition containing metallic and/or effect pigments is then applied, using a specific application technique, to the appropriately prepared old finish.

In the process according to the invention the aqueous basecoat composition is initially applied, in a first spray pass, to the pretreated old finish until a boundary is reached. Directly subsequent to this (i.e. without intermediate drying) the aqueous basecoat composition is applied, in a second spray pass, to the previously coated parts of the old finish, again until the boundary is reached. This means that, for example, initially the complete roof of a car is coated, in a first spray pass, with the aqueous basecoat composition. Directly subsequent to this the roof is then coated once more, in a second spray pass, with the aqueous basecoat composition.

In the next step of the process according to the invention the region of the old finish which adjoins the previously coated region of the old finish is coated with the aqueous basecoat composition again until a boundary is reached, in accordance with the previous directions, in two spray passes that follow in direct succession. This means, for example, that following the above-described coating of the roof, one wing of the car is first coated with the aqueous basecoat composition in two spray passes which follow in direct succession. The process step (c) described above is carried out until the entire component to be coated is provided with a basecoat. In the example described above, this means, for example, that after the coating of the wing, the adjacent door is then provided in turn with the basecoat in 2 spray passes.

This process step of area-by-area coating with the basecoat composition is repeated until the entire component to be coated is coated with the basecoat.

Between the first spray pass of the basecoat composition and the second spray pass of the aqueous basecoat composition that follows it, there is usually a flash-off time of less than 30 min, particularly preferably a flash-off time of less than 20 min. It is very particularly preferred to operate without a flash-off time between the first and the second spray passes.

The application of the basecoat composition is carried out under the conventional conditions. This means that, for example, a normal or only a slightly reduced spray-gun pressure is employed. The spray gun input pressure is preferably between 3.0 and 4.5 bar. The output pressure of the spray gun varies in this case depending on the spray gun used. When an HVLP (high-volume low-pressure) gun is used, it is, for example, between 0.6 and 0.7 bar. For the application of the basecoat composition, it is appropriate to use all spray guns that are conventionally employed for the application of basecoats, for example the abovementioned HVLP guns, but also normal pneumatic, high-performance spray guns (e.g., SATA-Jet 1,4E).

Aqueous basecoat compositions which are suitable for this process are all those that contain metallic and/or effect pigments and are conventionally employed for refinishing. Particularly suitable basecoat compositions are those containing as binder at least one polyurethane resin. Thus, for example, the aqueous basecoat compositions described in DE-A-40 09 000 are suitable. Also suitable are the aqueous basecoat compositions prepared using a mixer system.

Examples of suitable aqueous basecoat compositions are those that are prepared using the mixer system described in DE-A-41 10 520, in the nonprior publication German Patent Application P 42 32 721.0 and in the nonprior publication German Patent Application P 42 32 717.2.

After formation of a polymer film from the basecoat composition, preferably after drying of the basecoat at temperatures of below 140° C., preferably at temperatures below 80° C., for a period of 5–60 min, if desired after a brief cooling-down time of in general at least 5 min, a suitable transparent topcoat composition is applied to the basecoat. The dry film thickness of the topcoat is in general between 30 and 100 μm. The dry film thickness of the basecoat is in general between 10 and 25 μm.

Both 1- or 2-component clearcoats present as organic solutions and those in aqueous form are suitable as topcoat compositions. Clearcoats frequently employed are those based on an acrylate copolymer that contains hydroxyl groups and on a polyisocyanate. Examples of such clearcoats are described in Patent Applications DE-A-34 12 534, DE-A-36 09 519, DE-A-37 31 652, and DE-A-38 23 005. Also suitable are the moisture-curing clearcoats based on polyaddition polymers, containing alkoxysilane or aryloxysilane units, that are described in the International Patent Application having the international publication no. WO 88/02010.

After a flash-off time of about 5 minutes, if necessary, the topcoat is then dried, together, if appropriate, with the basecoat, at temperatures of up to 140° C., preferably at temperatures below 100° C., and particularly preferably at temperatures of from 60° to 80° C., for a period of 5–120 min.

Substrates that are suitable for the preparation of the multicoat refinish according to the invention are a very wide variety of substrates, for example old finishes (production-line finish or repair finish) and new parts that have been primed (mostly by electrodeposition, especially in the area of the finishing of heavy goods vehicle bodies). The process is employed in particular for the refinishing of entire components.

The invention is now illustrated in more detail in the following examples. In these examples, all parts and percentages are by weight unless expressly stated otherwise. The substrate used is a multicoat, simulated old finish, as is conventional in the production-line finishing of cars. In this context, it is irrelevant whether the paint systems involved are based on conventional or water-dilutable systems.

Simulation of an old finish

The substrate used is an electrodeposition-primed steel panel provided with a conventional commercial filler material based on a melamine-crosslinked polyester resin (FC60-7133 from BASF Lacke+Farben AG, Münster; dry film thickness 40 μm), a conventional commercial metallic basecoat based on cellulose acetobutyrate (AE54-9153 from BASF Lacke+Farben AG, Münster; dry film thickness 15 μm), and a conventional commercial clearcoat based on isocyanate-crosslinked acrylates that contain hydroxyl groups (AF23-0185 from BASF Lacke+Farben AG, Münster; dry film thickness 60 μm). After conventional drying (60° C., 30 min), the coated panel is additionally stored for several hours at elevated temperature, for example 60° C., in order to age the finish. The old finish simulated in this way is first cleaned, then roughened with sandpaper and cleaned again. The commercial 1-component primer-surfacer Glassohyd® 76–86W from BASF Lacke+Farben AG, Münster, is then applied in 2 spray passes to the old finish pretreated in this way, and the finish is dried at 60° C. for 30 min. This is followed by the application of the aqueous commercial refinish basecoat VW mint-met. VWL-B6/00U from BASF Lacke+Farben AG, Münster (dry film thickness 15 μm). Application is effected using the HVLP (high-volume low-pressure) spray gun SATA Jet B NR92 (nozzle width 1.3 mm) at a spray gun input pressure of 4.5 bar (spray gun output pressure 0.7 bar). In order to coat the car body provided with the above-described old finish, the roof is first sprayed to completion in 2 spray passes. Then spraying is begun on the wing and this spraying is completed with 2 spray passes. The next area (for example the door) is then sprayed to completion with 2 spray passes.

This process is continued area by area until the entire body has been completely coated with the basecoat. The basecoat is then dried for 10 min at 60° C. and allowed to cool for 5 min. The commercial 2-component clearcoat based on isocyanate-crosslinked acrylates that contain hydroxyl groups (AF 23-0185 plus SC 29-0173 plus SV 41-0391 from BASF Lacke+Farben AG, Münster; mixing ratio 2:1:0.6) is then applied to the basecoat. This clearcoat is applied at a dry film thickness of 60 μm. After a short flash-off time of 5 min the topcoat is subsequently dried at 60° C. for 30 min.

The coating obtained in this way exhibits outstanding surface properties. In particular, the resulting coating exhibits advantages in respect of clouding compared with coatings in which the complete car body is coated with the metallic basecoat in one spray pass and, after the entire body has been completed, the basecoat is again applied to the entire body in a second spray pass.

We claim:

1. A process for the preparation of a multicoat refinish of a component, comprising the steps of:

a. preparing the old finish located on the component by cleaning, sanding, and, if desired, applying at least one member of the group consisting of surfacers, filler materials, and mixtures thereof;

b. applying by spray application an aqueous basecoat composition containing at least one member of the group consisting of metallic pigments, effect pigments, and mixtures thereof;

c. forming a basecoat film from said applied basecoat composition;

d. applying a suitable transparent topcoat composition to said basecoat; and e. drying said topcoat together with said basecoat at temperatures of up to 140° C.;

wherein said aqueous basecoat composition application comprises the steps of:

(i) applying the aqueous basecoat composition in two spray passes to a first area of the pretreated old finish of the component until a boundary of said first area is reached;

(ii) repeating step (i) in a second area of the pretreated old finish adjoining said first area of the old finish coated in step (i) untii a new boundary is reached; and (iii) repeating step (ii) until the component to be coated is provided with a basecoat.

2. A process according to claim 1, wherein there is a flash-off time of less than 30 minutes between the two passes in step (i).

3. A process according to claim 1, wherein the basecoat film is formed by the basecoat composition being dried at temperatures of below 140° C. for a period of from 5 to 60 minutes.

4. A process according to claim 1, wherein the aqueous basecoat composition contains as binder at least one polyurethane resin.

5. A process according to claim 1, wherein the component is at least a part of a vehicle body.

6. A process according to claim 1, wherein the topcoat and the basecoat are dried together at temperatures below 100° C.

7. A process according to claim 1, wherein the topcoat and the basecoat are dried together at temperatures of from 60° to 80° C.

8. A process according to claim 2, wherein there is no flash-off time between the two passes in step (i).

9. A process according to claim 3, wherein the basecoat composition is dried at temperatures of below 80° C.

* * * * *